US011821148B2

(12) United States Patent
Wipfler

(10) Patent No.: US 11,821,148 B2
(45) Date of Patent: Nov. 21, 2023

(54) STOCK RAIL

(71) Applicants: voestalpine Turnout Technology Zeltweg GmbH, Zeltweg (AT); voestalpine Railway Systems GmbH, Leoben (AT)

(72) Inventor: Erich Wipfler, Kobenz (AT)

(73) Assignees: VOESTALPINE TURNOUT TECHNOLOGY ZELTWEG GMBH, Zeltweg (AT); VOESTALPINE RAILWAY SYSTEMS GMBH, Leoben (AT)

( * ) Notice: Subject to any disclaimer, the term of this patent is extended or adjusted under 35 U.S.C. 154(b) by 505 days.

(21) Appl. No.: 17/053,897

(22) PCT Filed: Jun. 11, 2019

(86) PCT No.: PCT/AT2019/000016
§ 371 (c)(1),
(2) Date: Nov. 9, 2020

(87) PCT Pub. No.: WO2019/237136
PCT Pub. Date: Dec. 19, 2019

(65) Prior Publication Data

US 2021/0269985 A1 Sep. 2, 2021

(30) Foreign Application Priority Data

Jun. 12, 2018 (AT) ..... A 170/2018

(51) Int. Cl.
*E01B 7/02* (2006.01)

(52) U.S. Cl.
CPC ..... *E01B 7/02* (2013.01)

(58) Field of Classification Search
CPC ..... E01B 5/04; E01B 7/00; E01B 7/02; E01B 7/20; E01B 2201/00; E01B 2201/02;
(Continued)

(56) References Cited

U.S. PATENT DOCUMENTS 175,699 A 4/1876 Harreff
1,177,670 A * 4/1916 Woods ..... B61F 9/00 246/436

(Continued)

FOREIGN PATENT DOCUMENTS

AT 007310 U1 1/2005
CN 202543735 U * 11/2012 ..... E01B 7/02

(Continued)

OTHER PUBLICATIONS

International Search Report dated Aug. 2, 2019 issued in corresponding International Application No. PCT/AT2019/000016 w/English translation (4 pgs.).

*Primary Examiner* — Zachary L Kuhfuss
*Assistant Examiner* — Cheng Lin
(74) *Attorney, Agent, or Firm* — Pillsbury Winthrop Shaw Pittman, LLP

(57) ABSTRACT

In a stock rail for use in a railroad switch, there are a rail head, a rail web and a rail foot, wherein the stock rail has a first longitudinal section forming an abutment region for a tongue rail and a second longitudinal section lying outside the abutment region, wherein the stock rail in the second longitudinal section has a cross-sectional base profile with a central axis extending through the center of the rail head cross section, wherein the rail head in the first longitudinal section is machined starting from the cross-sectional base profile so that the running edge, compared to the base profile, lies closer to the central axis of the stock rail, the rail head having substantially no width reduction at least at a first point within the first longitudinal section and having a maximum width reduction at least at a second point within the first longitudinal section, it is provided that the running edge at the first point and the running edge at the second point lie substantially in a common running edge plane.

14 Claims, 3 Drawing Sheets

(58) Field of Classification Search
CPC ..... E01B 2202/025; E01B 2202/027; E01B 2202/04; E01B 2202/042
See application file for complete search history.

(56) References Cited

U.S. PATENT DOCUMENTS

| | | | | |
|---|---|---|---|---|
| 7,387,280 | B2 * | 6/2008 | Fritz | E01B 7/02 246/442 |
| 9,453,307 | B2 * | 9/2016 | Gsodam | E01B 7/02 |

FOREIGN PATENT DOCUMENTS

| | | | | | |
|---|---|---|---|---|---|
| CN | 202543735 | U | | 11/2012 | |
| CN | 203602971 | U | | 5/2014 | |
| DE | 487877 | C | | 12/1929 | |
| DE | 2046391 | A1 | | 3/1972 | |
| EP | 0040533 | A2 | | 11/1981 | |
| EP | 1516091 | A1 | | 3/2005 | |
| KR | 20100098149 | A | * | 9/2010 | E01B 7/02 |
| KR | 20100098149 | A | | 9/2010 | |
| WO | 2004/003295 | A1 | | 1/2004 | |
| WO | 2014/187437 | A1 | | 11/2014 | |
| WO | WO-2014187437 | A1 | * | 11/2014 | E01B 7/02 |

* cited by examiner

STOCK RAIL

CROSS-REFERENCE TO RELATED APPLICATIONS

This application is a national stage entry of PCT/AT2019/000016, filed Jun. 11, 2019, which claims priority to Austrian Application No. A 170/2018, filed Jun. 12, 2018, the entire contents of all of which are herein incorporated by reference in their entireties.

The invention relates to a stock rail for use in a railroad switch, comprising a rail head, a rail web and a rail foot, wherein the stock rail comprises a first longitudinal section forming an abutment region for a tongue rail and a second longitudinal section lying outside the abutment region, wherein the stock rail in the second longitudinal section has a cross-sectional base profile with a central axis extending through the center of the rail head cross section, wherein the rail head in the first longitudinal section is machined starting from the cross-sectional base profile, comprising a chamfer inclinedly extending from a running edge to the rail web, wherein the running edge is formed at a point of the cross section of the rail head that has the largest normal distance to the central axis, and comprising a gradual width reduction of the rail head such that the running edge, compared to the base profile, lies closer to the central axis of the stock rail, the rail head at least at a first point within the first longitudinal section having substantially no width reduction and at least at a second point within the first longitudinal section having a maximum width reduction.

The invention further relates to a railroad switch comprising a stock rail and a tongue rail.

When passing a switch, high forces act on the rails and, in particular, high transverse forces depending, in particular, on the radius of curvature and the deviation angle of the switch, on the speed at which the switch is passed, and on the axle load. The major portion of these transverse forces has to be taken up by the tongue rail, wherein especially high loads caused by high inertial and centrifugal forces are to be observed particularly with inside curve switches, in which the branch track branches off a curved main track towards the inner side of the curve. This leads to increased wear, thus considerably reducing the service life. Moreover, modern switches have to be passable at very high speeds, which inevitably results in tongue rails having long, thin tips, and hence in an elevated susceptibility to wear. Consequently, it has already been proposed several times to produce tongue rails of special, wear-resistant materials or harden them by subsequent treatment. However, this involves a number of disadvantages, wherein, for instance, head-hardened tongue rails are generally not employed for safety reasons, because possible wear phenomena on the tongue rail should be visible so as to enable the premature recognition of possible risks of fracture. Yet, fractures with head-hardened tongue rails are mostly brittle fractures, which make early detection impossible.

In the past, tongue rails reinforced in thickness have, therefore, been frequently proposed to enable the safe absorption of transverse forces. Thus, tongue rails have become known from DE-OS 2,046,391, whose tongue ends comprise reinforcements in the direction towards the stock rails to which recesses provided on the running edges of the stock rails correspond. The tongue rail, in its position abutting against the stock rail, engages in the recesses of the stock rail so as to provide a continuous running edge in the transition from the stock rail to the tongue. However, in the configuration according to DE-OS 2,046,391, the recesses formed in the stock rail caused substantial weakening of the stock rail, and it is, therefore, necessary to fill the recesses of the stock rail with levelling wedges in the open or spaced-apart position of the tongue. A configuration in which the tongue rail engages in a recess of the stock rail in its position abutting against the stock rail is also known from US-A-175,699. From EP 040533 A2 it has, furthermore, become known to reduce the width of a stock rail in its head and foot regions in a zone in which the tongue rail contacts the stock rail, so as to enable the tongue to be designed in correspondence with the profile of the rail head in this transition region. Yet, also with that solution, the profile of the stock rail is strongly weakened, thus causing an elevated risk of fracture. In order not to be forced to extensively reduce the cross section of the stock rail while, nevertheless, obtain an adequate reinforcement of the tongue rail, the rail head profile of the stock rail is frequently chamfered obliquely downwards in the tongue abutment region, as is, for instance, known from DE PS 487877.

In those proposals for reinforcing the cross section of a tongue rail in the region of abutment, it has, however, turned out that no substantial improvement of the wear resistance of the tongue rails has been observed and, in addition, undesired changes in the course of the running edge are caused by the material reduction on the running edge of the stock rail. Deviations from the straight-line course of the running edge produce harsh shocks on the vehicle at high speeds and, therefore, have to be avoided in any event.

In order to reduce or avoid these problems, EP 1516091 A1 has proposed a railroad switch in which, in the region of abutment of the tongue rail on the stock rail, the reduction of the width of the stock rail cross section, or the reinforcement of the tongue rail, is effected in a manner increasing in a first region and decreasing in a second region following upon the former, rather than uniformly. This offers the opportunity of adapting the degree of reinforcement of the tongue rail to the course of the transverse forces so as to impart to the tongue rail an enhanced wear resistance and an extended lifetime in the track by the reinforcement of the tongue in the front region, so that the safety will be enhanced by reducing the risk of fracture while, at the same time, the original course of the running edge will be influenced as little as possible so as to increase the comfort during the passing of the switch.

That configuration, however, involves the drawback that, due to the reduction of the width of the stock rail head by a chamfer in the upper region of the stock rail head, the risk of burr formation exists in the region of abutment, because the angle between the chamfer and the adjoining surface of the stock rail head becomes more acute as more material is removed, i.e. the width of the stock rail head is reduced. When passing over a stock rail with the tongue rail open, a running wheel comes into lateral contact with the stock rail in the region of the burr, since the stock rail has its largest head width there. Due to this load, there is the risk of splitting in the region of the burr, which is why the wear of the stock rails is considerably increased as compared to an unmachined stock rail head. In this configuration, also the contact geometry will be additionally changed with the tongue rail open, thus causing uneven running in this region.

It is, therefore, the object of the invention to reduce the risk of splitting on the stock rail, which is, in particular, caused by the passage of a running wheel when the tongue rail is in spaced-apart relationship, and hence reduce the wear of the stock rail. Furthermore, smooth running of the running wheel is to be enabled, in particular with the tongue rail open.

To solve this object, it is provided in a stock rail of the initially defined kind that the running edge at the first point and the running edge at the second point lie substantially in a common running edge plane disposed at a right angle relative to the central axis. Preferably, the running edge lies in the same running edge plane not only at the first and the second points, but over a continuous longitudinal section between the first and the second points, in particular over the entire first longitudinal section, i.e. over the entire region of abutment of the tongue rail. The altitude of the running edge will thus remain unaffected by any width reduction such that the angle between the chamfer extending from the running edge obliquely downward and the contiguous surface of the stock rail head can be designed in such a manner as to avoid the formation of burrs. Even in the region of the maximum width reduction, said angle can, in particular, be substantially designed as at the first point without width reduction, in which the chamfer extends downwards from the running edge of the base profile. In other words, the invention enables a configuration in which the width reduction of the stock rail head is substantially effected by the horizontal displacement of the chamfered stock rail base profile. As opposed to the prior art, the intersection of the chamfer with the adjacent, curved surface region of the rail head with the width reduction increasing will not cause a rise of the running edge combined with an angle of intersection that becomes more acute, but the geometric conditions can be kept constant over the length.

The cross-sectional base profile preferably corresponds to a Vignol rail.

It is preferably provided that the rail head, when viewed in cross section, has a curved surface section extending upwardly from the running edge, and an angle is formed between the chamfer and the tangent of the curved surface section passing through the running edge, which angle, at least at the first and second points, preferably along the entire first longitudinal section, is larger by 0-20° than the angle between the chamfer and the central axis, wherein said angle is preferably equal at the first and second points, preferably along the entire first longitudinal section. The choice of the said angle ensures that, on the one hand, the running edge will lie at the widest point of the stock rail head and, on the other hand, the bend or angulation formed on the surface by the running edge will not be too strong.

Furthermore, it is preferably provided that the rail head in the first longitudinal section, in the transverse section located vertically above the running edge plane, comprises a region whose shape substantially corresponds to the respective shape of the base profile. The proven shape of the base profile is thus maintained to the largest extent possible so as to enable smooth passing of the running wheel on the stock rail. In a particularly preferred manner, it is provided that this region borders on the running edge. Above this region may, for instance, be provided a curvature with a small radius to provide a transition to the cross-sectional base profile.

In a particularly preferred manner, it is provided that the normal distance between the central axis and the rail head edge above the running edge plane decreases continuously. This is, for instance, enabled by a curved course. In this case, no regions in which the normal distance between the central axis and the rail head edge increases are thus provided above the running edge, so that there is no additional burr, which would be prone to wear.

It is preferably provided that the chamfer comprises an inclination of 1:2.5-1:3.5, in particular 1:3. Thus, a taper is formed vertically downwards, which enables the safe abutment of the tongue rail on the stock rail.

It is preferably provided that the running edge at the second point within the first longitudinal section lies closer to the central axis by 5-15 mm, preferably 6-10 mm, as compared to the first point, thus enabling an appropriate reinforcement of the tongue rail. Thereby, a sufficient increase in the width of the tongue rail is achieved without extensively offsetting the running edge of the stock rail when the tongue rail is in a spaced-apart relationship.

The running edge of the rail results on the rail head at the widest point measured at a predefined or standardized vertical distance from the upper running edge. It is preferably provided that the running edge plane in the first longitudinal section is located at a vertical distance of 10-20 mm, in particular 14 mm, from the upper running edge of the rail head.

In a preferred configuration it is provided that the normal distance of the running edge from the central axis decreases gradually from the first point to the second point, and in the region following the second point increases again, preferably gradually. This, in particular, offers the possibility of adapting the degree of reinforcement of the tongue rail to the course of transverse forces along the rail. In this respect, it may, in particular, be provided that the normal distance of the running edge from the central axis decreases linearly, i.e. along a straight line, from the first point to the second point, and in the region following the second point again increases linearly.

Alternatively, it is provided that the normal distance of the running edge from the central axis decreases arcuately from the first point to the second point, and in the region following the second point increases again, preferably arcuately.

The invention further provides a railroad switch comprising a stock rail according to the invention and a tongue rail, said tongue rail being arranged to be abuttable against the stock rail.

In this context, it is preferably provided that the tongue rail is designed to be reinforced in cross section towards the stock rail as a function of the reduction of the width of the stock rail head.

A further preferred configuration contemplates that the width of the stock rail head, starting from the tip of the tongue rail in the closed state of the tongue rail, decreases to a point within the first longitudinal section forming the region of abutment, at which point a running wheel passing the track contacts the tongue rail laterally, and increases in the first longitudinal section following thereupon, and that the tongue rail is designed to be reinforced in cross section towards the stock rail as a function of the reduction of the width of the stock rail head. The largest reinforcement of the tongue rail is thus provided in the sensitive transition of the load from the stock rail to the tongue rail, and thereby an increase in the cross section and hence an increase in the moment of inertia of the tongue rail will be achieved so as to render the tongue rail better able to withstand the elevated transverse forces. Due to the preferably continuous change of cross section, sudden track changes will be avoided so as to prevent adverse effects on the travelling comfort and avoid impact loads on the rails.

A particularly resilient and wear-resistant railroad switch will result if the largest reinforcement of the tongue rail is provided in that region in which the running wheel contacts the tongue rail laterally, and the railroad switch according to the invention in a preferred configuration is, therefore, further developed such that the point of the largest reinforcement of the tongue rail, or the smallest width of the stock rail head, is located at a distance of ⅙ to ⅓, preferably ¼, of the length of the abutment of the tongue rail on the stock rail from the tip of the tongue.

Alternatively, it may be provided that the point of the largest reinforcement of the tongue rail is located near the tip of the tongue, and in this respect the configuration is devised such that the point of the largest reinforcement of the tongue rail, or smallest width of the stock rail head, is located at a distance of 1/20 to 1/10 of the length of the abutment of the tongue rail on the stock rail from the tip of the tongue.

In order to achieve a particularly smooth transition of the running wheel from the stock rail to the tongue rail, the switch is advantageously further developed such that the vertical height of the tongue rail, in the region of the abutment against the stock rail, increases towards the end of the abutment, starting from the tip of the tongue. This provides a continuous transition of the rolling load from the stock rail to the tongue rail.

In this context, it is, in particular, provided that the tongue rail, on the tip of the tongue, is arranged below the running edge of the stock rail so that no contact will occur between a running wheel and the tongue rail on the tip of the tongue, and that the tongue rail reaches into the running edge plane at the point of the maximum width reduction of the stock rail. In that the tongue rail reaches into the running edge plane at the point of the maximum width reduction of the stock rail, the running wheel is able to laterally contact the tongue rail in the region of this point.

In the following, the invention will be explained in more detail by way of an exemplary embodiment illustrated in the drawing. Therein, FIG. 1 is a top view of a first configuration of a railroad switch according to the invention, FIG. 2 is a top view of a second configuration of a railroad switch according to the invention, FIG. 3 is a top view of a third configuration of a railroad switch according to the invention, FIG. 4 depicts a cross section of the railroad switch according to the invention along line A-A of FIGS. 1-3, FIG. 5 depicts a cross section of the railroad switch according to the invention along line B-B of FIGS. 1-3, FIG. 6 depicts a cross section of the railroad switch according to the invention along line C-C of FIGS. 1-3, FIG. 7 is a detailed view of the cross section of a stock rail according to the invention, and FIG. 8 is a detailed view of the stock rail according to the invention with an abutting tongue rail.

FIG. 1 depicts a railroad switch according to the invention in a first configuration, comprising a stock rail 1 and a tongue rail 2. In this illustration, the tongue rail 2 abuts against the stock rail 1 in a first longitudinal section 3 forming a region of abutment. A second longitudinal section 4 is each provided upstream and downstream of the first longitudinal section 3, viewed in the longitudinal direction, in which second longitudinal section the stock rail 1 each has a cross-sectional base profile. In the first longitudinal section 3, the cross-sectional base profile is machined such that the head of the stock rail 1 comprises a chamfer and, opposite the longitudinal sections 4, a width reduction. The tongue rail 2 is designed to be reinforced as a function of the reduction of the width of the stock rail head, thus being able to cooperate with the stock rail 1 in the first longitudinal section. The largest reinforcement of the tongue rail is provided in the region of section B-B, in which the running wheel contacts the tongue rail laterally, because the wear is the largest in this region due to the sudden introduction of transverse forces.

The width of the head of the stock rail 1, starting from the beginning of the first longitudinal section 3 (section A-A), i.e. starting from the tip of the tongue rail 2, decreases continuously to a point at section B-B of minimum width. After this, the head of the stock rail 3 becomes wider again until the cross-sectional base profile is again reached in the longitudinal section 4.

Figure 1:
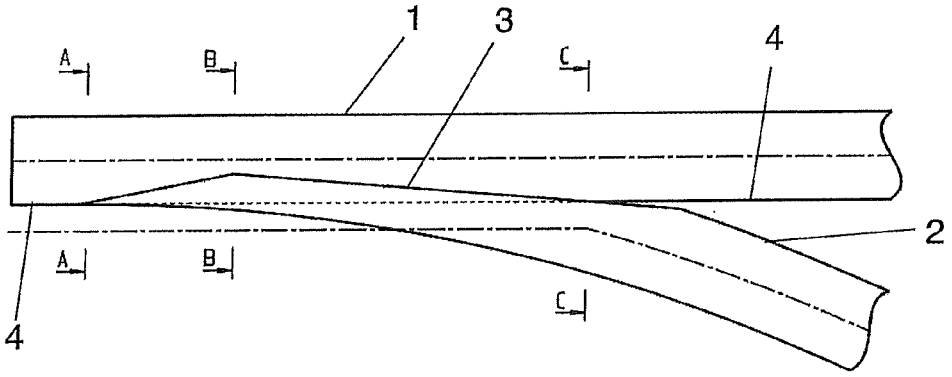

Section A-A is located at the beginning of the first longitudinal section 3 at the tip of the tongue rail 2. The rail head 5 of the stock rail 1 comprises a chamfer 6 which, in the abutting state of the tongue rail 2, cooperates with a corresponding chamfer of the tongue rail 2. The running edge of the stock rail 1 is denoted by 7 and located in a running edge plane 8 disposed at a right angle relative to a central axis 9 extending through the center of the rail head 5. The running edge 7 is formed at an intersection of the chamfer 6 with an adjacent, curved surface section, wherein the largest normal distance between the stock rail head edge and the central axis 9 lies in the running edge plane 8, in which the running edge 7 is arranged. At this first point, the running edge 7 is not shifted towards the central axis 9, compared to the cross-sectional base profile. The tongue rail 2 has a reduced height at the tip of the tongue such that the latter lies clearly below the running edge plane 8, thus preventing contact by a running wheel.

Figure 5:
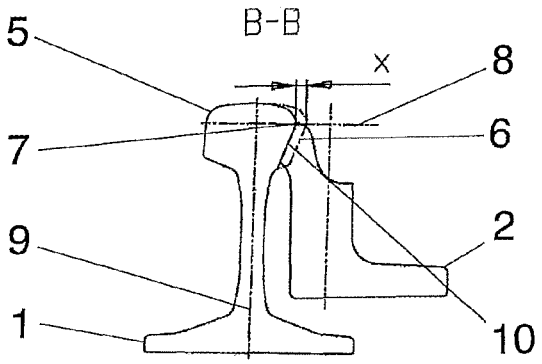
Figure 6:
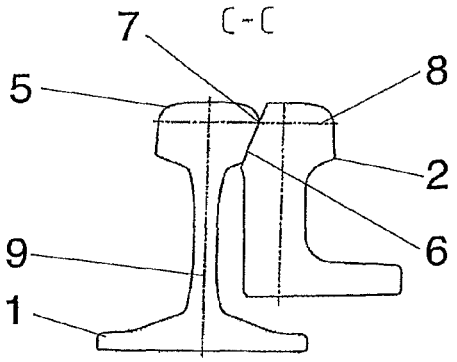

Section B-B lies at the second point, i.e. the point of the largest width reduction of the stock rail head 5. Compared to the stock rail 1 in section A-A, which is illustrated in broken lines, more material has been removed by the chamfer 10, the chamfer 10 thus lying closer to the central axis 9. In this section, also the running edge 7 lies closer to the central axis 9 by a distance x and in the same running edge plane 8 as the running edge 7 in section A-A. The tongue rail 2 is designed to be widened by the same measure x. The tongue rail 2 is formed with a height increasing away from the tip of the tongue such that the tongue rail 2 already reaches into the running edge plane 8 at the point shown in FIG. 5.

Section C-C lies at the end of the first longitudinal section 3, and the stock rail 1 has substantially the same profile as in section A-A, the tongue rail 2 having reached the same height as the stock rail.

Figure 2:
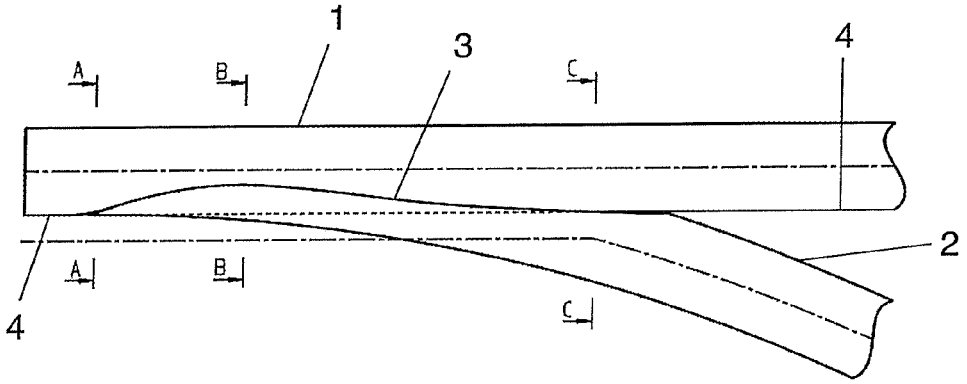
FIG. 2 depicts a second railroad switch according to the invention, wherein, as opposed to the configuration according to FIG. 1, the course of the stock rail width, starting from the tip of the tongue rail, initially decreases arcuately and subsequently again increases arcuately.
Figure 3:
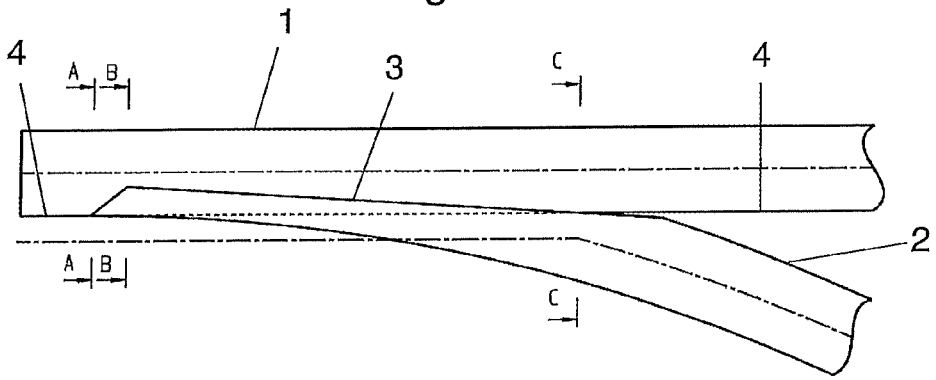
FIG. 3 depicts a third railroad switch according to the invention, wherein, as opposed to the configuration according to FIG. 1, the course of the stock rail width, starting from the tip of the tongue rail, decreases within a short longitudinal section near the tip of the tongue and subsequently increases again.
Figure 4:
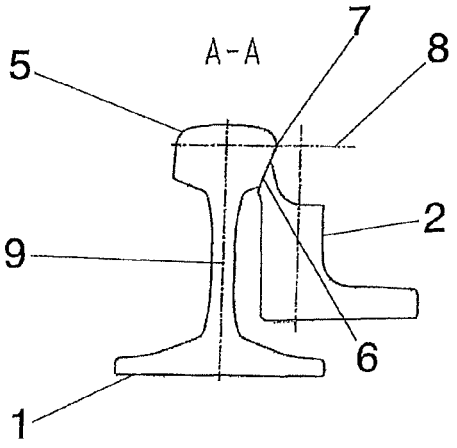
FIGS. 4, 5 and 6 depict three sections along lines A-A, B-B and C-C, respectively, of FIGS. 1 to 3.
Figure 7:
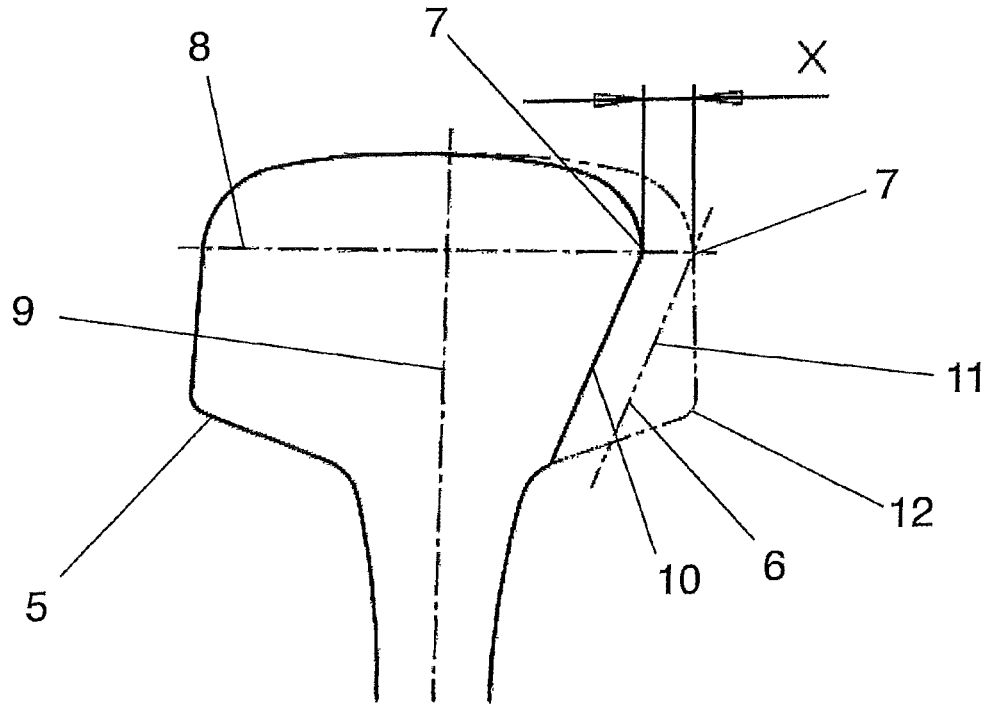

FIG. 7 depicts a detailed view of the stock rail head 5. The cross-sectional profile in section B-B according to FIGS. 1-3 is illustrated by a full line, the cross-sectional profiles in section A-A and C-C, respectively, according to FIGS. 1-3 is illustrated by broken line 11, and the cross-sectional base profile in the second longitudinal section 4 is illustrated by broken line 12. It is apparent that, starting from the cross-sectional base profile 12, a chamfer 6 is provided to obtain the profile according to line 11, wherein the running edge 7 is not machined. In order to produce an even larger material removal on the stock rail head 5, the chamfer 10 is provided vertically below the running edge plane 8, on the one hand, and a curvature departing from the running edge 7 is provided vertically above the running edge plane 8. The curvature is characterized by a tangent passing through the running edge 7, the angle of said tangent to the central axis 9 in section A-A being equal to that in section B-B. The running edge 7 in this case is not displaced in the vertical direction, still being in the running edge plane 8. By contrast, the running edge 7 is displaced in the horizontal direction by the distance x in the direction of the central axis 9.

Figure 8:
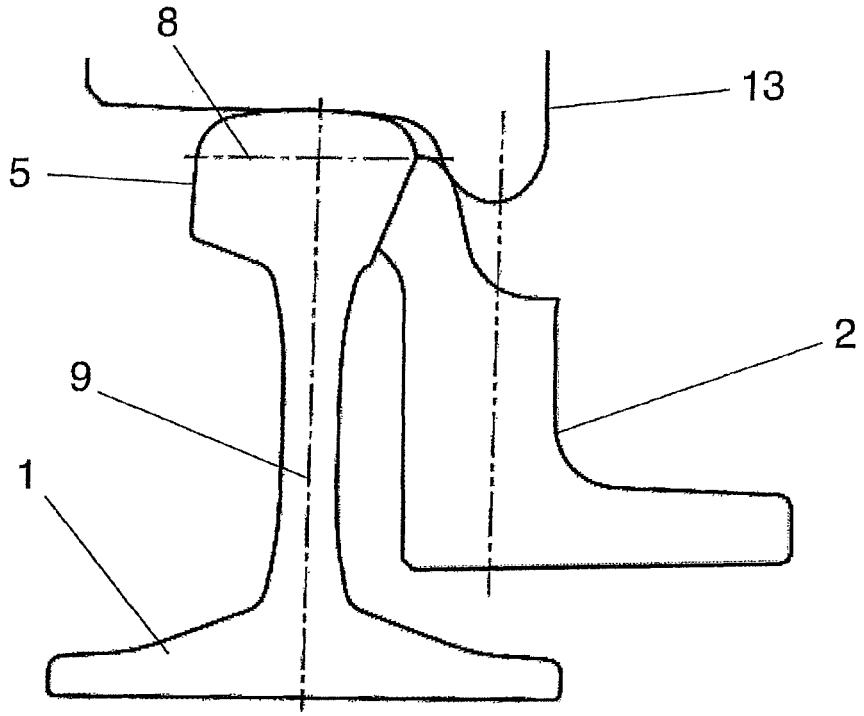

FIG. 8 illustrates the stock rail 1 according to the invention along section B-B together with an abutting tongue rail 2 and a running wheel 13, and it is apparent that at the point of the largest width reduction of the stock rail, or at the point of the largest tongue rail widening, lateral contact between the running wheel and the tongue rail occurs.

The invention claimed is:

1. A stock rail for use in a railroad switch, comprising a rail head, a rail web and a rail foot, wherein the stock rail comprises a first longitudinal section forming an abutment region for a tongue rail and a second longitudinal section lying outside the abutment region, wherein the stock rail in the second longitudinal section has a cross-sectional base profile with a central axis extending through a center of a cross section of the rail head, wherein the rail head in the first longitudinal section is machined starting from the cross-sectional base profile, comprising a chamfer inclinedly extending from a running edge to the rail web, wherein the running edge is formed at a point of the cross section of the rail head that has the largest normal distance to the central axis, and wherein the rail head in the first longitudinal section comprises a gradual width reduction in a longitudinal direction of the rail head extending from at least a first point within the first longitudinal section having substantially no width reduction to at least a second point within the first longitudinal section having a maximum width reduction, wherein the running edge at the first point is formed at a point of the cross section of the rail head that has the largest normal distance to the central axis and the running edge at the second point is formed at a point of the cross section of the rail head that has the largest normal distance to the central axis, wherein the gradual width reduction results in that the running edge at the second point lies closer to the central axis of the stock rail than the running edge at the first point, wherein the running edge at the first point and the running edge at the second point lie substantially in a common running edge plane disposed at a right angle relative to the central axis.

2. A stock rail according to claim 1, characterized in that the rail head, when viewed in cross section, has a curved surface section extending upwardly from the running edge, and a first angle is formed between the chamfer and a tangent of the curved surface section passing through the running edge, which the first angle, at least at the first and second points, is larger by 0°-20° than a second angle between the chamfer and the central axis.

3. A stock rail according to claim 1, characterized in that the rail head in the first longitudinal section, in a transverse section located vertically above the common running edge plane, comprises a region whose shape substantially corresponds to the respective shape of the cross-sectional base profile.

4. A stock rail according to claim 1, characterized in that the normal distance between the central axis and an edge of the rail head above the common running edge plane decreases continuously.

5. A stock rail according to claim 1, characterized in that the chamfer comprises an inclination of 1:2.5-1:3.5.

6. A stock rail according to claim 1, characterized in that the running edge at the second point within the first longitudinal section lies closer to the central axis by 5-15 mm as compared to the first point.

7. A stock rail according to claim 1, characterized in that the common running edge plane in the first longitudinal section is located at a vertical distance of 10 mm-20 mm from an upper running edge of the rail head.

8. A stock rail according to claim 1, characterized in that the normal distance of the running edge from the central axis decreases gradually from the first point to the second point, and in the region following the second point, the normal distance of the running edge from the central axis increases again.

9. A stock rail according to claim 1, characterized in that the normal distance of the running edge from the central axis decreases arcuately from the first point to the second point, and in the region following the second point the normal distance of the running edge from the central axis increases again.

10. A railroad switch comprising a stock rail according to claim 1 and a tongue rail, said tongue rail being arranged to be abuttable against the stock rail.

11. A railroad switch according to claim 10, characterized in that the tongue rail is designed to be reinforced in cross section towards the stock rail as a function of the reduction of the width of the rail head of the stock rail.

12. A railroad switch according to claim 11, characterized in that the width of the rail head of the stock rail, starting from a tip of the tongue rail in a closed state of the tongue rail, decreases to a point within the first longitudinal section forming the abutment region, at which point a running wheel passing a track contacts the tongue rail laterally, and increases in the first longitudinal section following thereupon, and that the tongue rail is designed to be reinforced in cross section towards the stock rail as a function of the reduction of the width of the rail head of the stock rail.

13. A railroad switch according to claim 12, characterized in that a vertical height of the tongue rail in the abutment region on the stock rail increases towards an end of abutment, starting from the tip of the tongue rail.

14. A railroad switch according to claim 13, characterized in that the tongue rail, on the tip of the tongue, is arranged below the running edge of the stock rail, and that the tongue rail reaches into the common running edge plane at the point of the maximum width reduction of the stock rail.

* * * * *